US009175835B2

(12) United States Patent
Machiorlette

(10) Patent No.: US 9,175,835 B2
(45) Date of Patent: Nov. 3, 2015

(54) PENDANT LIGHT FIXTURE AND SUPPORT STUD

(71) Applicant: Steven C. Machiorlette, Houston, TX (US)

(72) Inventor: Steven C. Machiorlette, Houston, TX (US)

(73) Assignee: Worth Home Products, Houston, TX (US)

( * ) Notice: Subject to any disclaimer, the term of this patent is extended or adjusted under 35 U.S.C. 154(b) by 8 days.

(21) Appl. No.: 13/952,957

(22) Filed: Jul. 29, 2013

(65) Prior Publication Data

US 2014/0036517 A1 Feb. 6, 2014

Related U.S. Application Data

(60) Provisional application No. 61/677,753, filed on Jul. 31, 2012.

(51) Int. Cl.

| | |
|---|---|
| ***F21S 8/06*** | (2006.01) |
| ***F21V 21/008*** | (2006.01) |
| ***F21V 27/00*** | (2006.01) |
| *F21V 23/06* | (2006.01) |

(52) U.S. Cl.

CPC ..... *F21V 21/008* (2013.01); *F21S 8/061* (2013.01); *F21V 27/00* (2013.01); *F21V 23/06* (2013.01)

(58) Field of Classification Search

USPC ..... 362/147, 258, 391, 404, 407, 408, 429, 362/430

See application file for complete search history.

(56) References Cited

U.S. PATENT DOCUMENTS

| | | | | | |
|---|---|---|---|---|---|
| 1,005,902 | A | * | 10/1911 | Taylor | 362/258 |
| 1,108,453 | A | * | 8/1914 | MacBeth | 362/429 |
| 1,375,224 | A | * | 4/1921 | MacLewee | 362/407 |
| 1,702,888 | A | * | 2/1929 | Balch | 248/343 |
| 1,972,056 | A | * | 8/1934 | Saaf | 362/429 |
| 4,233,655 | A | * | 11/1980 | Zelina et al. | 362/258 |
| 4,300,732 | A | * | 11/1981 | Gaeta | 242/379.2 |
| 4,378,473 | A | * | 3/1983 | Noorigian | 191/12.2 R |
| 4,422,137 | A | * | 12/1983 | Watts | 362/390 |
| 6,161,943 | A | * | 12/2000 | Chang | 362/258 |
| 7,478,927 | B2 | * | 1/2009 | Matthew et al. | 362/258 |

* cited by examiner

*Primary Examiner* — Ismael Negron

(74) *Attorney, Agent, or Firm* — Brient Globerman, LLC

(57) ABSTRACT

A pendant fixture comprising a first body portion having a threaded stud formed thereon, wherein the threaded stud is configured to receive a spider fitting of a lampshade when the lampshade is installed on the pendant fixture. A second body portion having a first half defining a threaded bore therein and a second half defining a second bore therethrough is rotatably coupled to the first body portion by the threaded stud and bore. A power cord having a first end for mounting to a structure, and a second end that is received through the second body portion second bore provides power to the first body portion. A length of power cord adjacent to the power cord second end defines a flexible and adjustable C-shaped cord portion intermediate the first body portion and the second body portion.

15 Claims, 5 Drawing Sheets

PENDANT LIGHT FIXTURE AND SUPPORT STUD

CLAIM OF PRIORITY

This application claims the benefit of and incorporates by reference, in its entirety, U.S. Provisional Patent Application No. 61/677,753, filed Jul. 31, 2012 and entitled "Pendant Light Fixture."

BACKGROUND

Pendant lamps, e.g., lamps which hang from a ceiling or other elevated support by a chain, cable, or even from a power cord, have long been popular illumination devices in homes and elsewhere. Recently, commercial interest has been shown in fitting a pendant light fixture with standard floor and table lampshades. In most cases, standard floor and table lamps are constructed with a spider-type fitter ring that is too smaller in diameter to accept a pendant fixture's bulb socket, which is larger and typically used in conjunction with a socket ring to hold the pendant shade. In certain current lighting arrangements, when fitting a table or standing lampshade to a pendant light fixture, certain lampshades are two short and do not provide a clean and balanced appearance.

SUMMARY OF THE INVENTION

A pendant lamp according to various embodiments allows a user to install a standard floor or table lampshade on the pendant fixture. In particular embodiments, the pendant body is formed from two parts that attach to one another via a coupling. A flexible C-shaped portion of the power cord extends between the pendant's two primary body parts to allow the body parts to be moved with respect to one another. Moreover, once the body parts are coupled together, the C-shaped portion of the cord is adjustable so that the length of the cord can be reduced to streamline the appearance of the fixture. As such, a standard lampshade having a spider-type fitting may be positioned between the body parts and retained on the pendant lamp in proper alignment with the fixture using a streamlined hardware arrangement. The described orientation provides various advantages that include, but are not limited to, a balanced aesthetic look since the length of the c-shaped cord can be adjusted to hug the two body parts, a balanced weighting, which allows the pendant lamp and shade to hang in a proper orientation, and a reduced overall length to allow for low profile shades.

In various embodiments, the invention is directed to a pendant light fixture having a first body portion, a second body portion comprising a light bulb socket, and a flexible power cable that is adapted to extend through a portion of the first body portion and between the first body portion and the second body portion. In various embodiments, the power cable is adapted to power the light bulb socket, and the first body portion and second body portion are configured to be selectively attached to each other and to thereby support a lamp shade.

In various embodiments, the pendant light fixture comprises a stud that facilitates the attachment of the first body portion to the second body portion. The stud also facilitates attachment of the lamp shade to the pendant light fixture. In some of these embodiments, the stud is adapted to extend through a substantially circular opening in the lamp shade when the lamp shade is attached to the pendant light fixture. In various embodiments, one of the first and second body portions includes the stud and the other one of the first and second body portions includes a blind bore that is configured to receive the stud. In still other embodiments, the stud is threaded and the bore contains a corresponding threaded wall adapted to receive the threaded stud. In other embodiments, the stud is formed from a metal and a wall of the bore is magnetized to releasably maintain the stud in the bore. In yet other embodiments, a portion of the power cable extends adjacent corresponding lateral sides of the first and second body portions when the first and second body portions are attached to each other.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

DETAILED DESCRIPTION OF VARIOUS EMBODIMENTS

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. For instance, features illustrated or described as part of one embodiment may be used in another embodiment to yield a still further embodiment. Thus, the present system and methods cover such modifications and variations as come within the scope of the appended claims and their equivalents.

Pendant Lamp Structure

Figure 1:
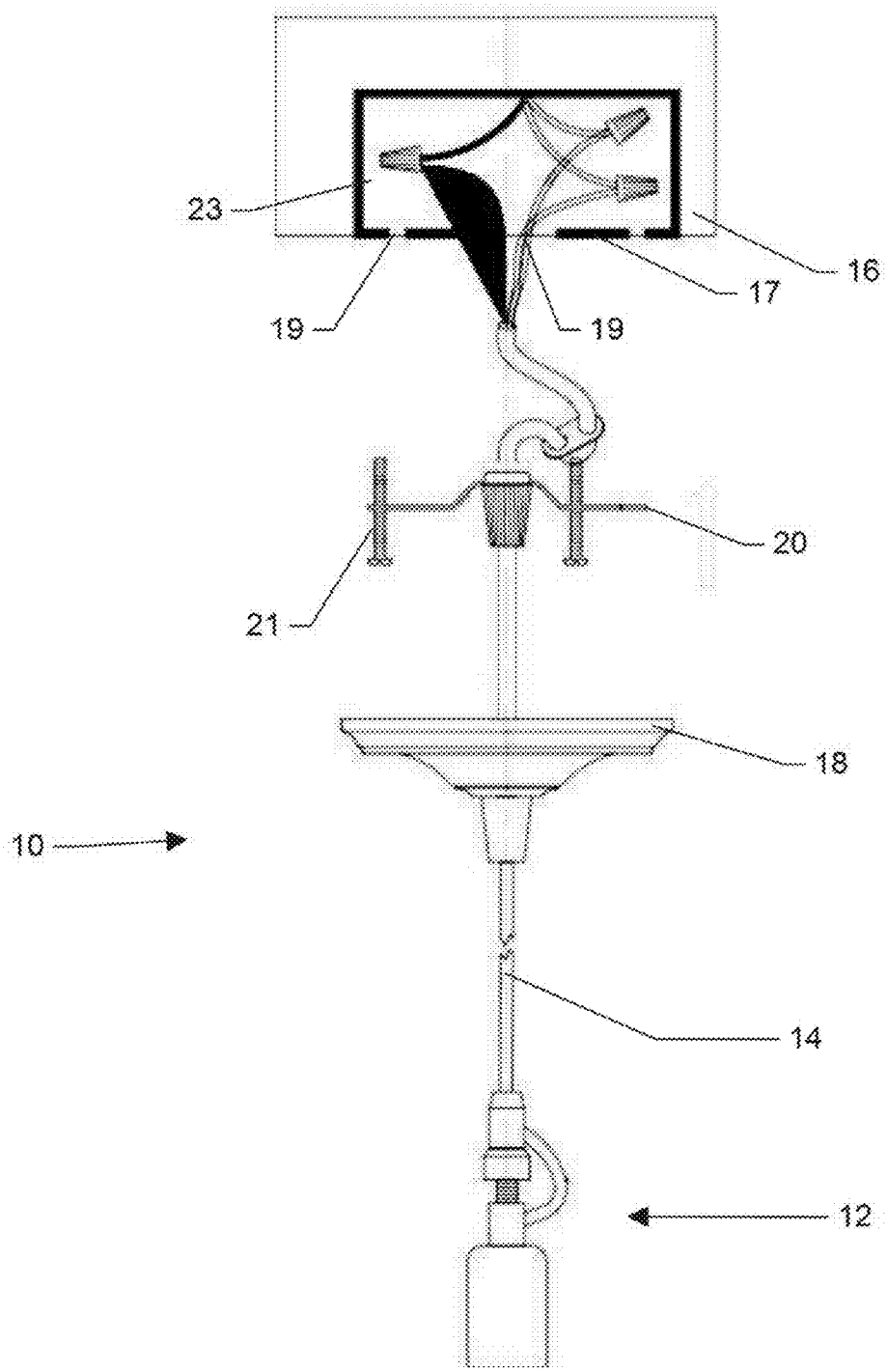
FIG. 1 is a plan view of a first embodiment of a pendant lamp.
Figure 2B:
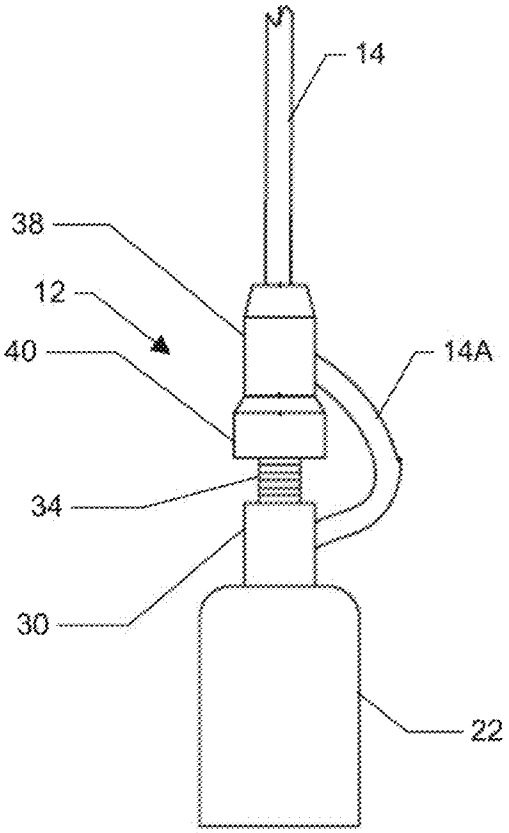
FIG. 2B is a detailed view of the pendant lamp of FIG. 1 in an engaged arrangement.
Figure 2A:
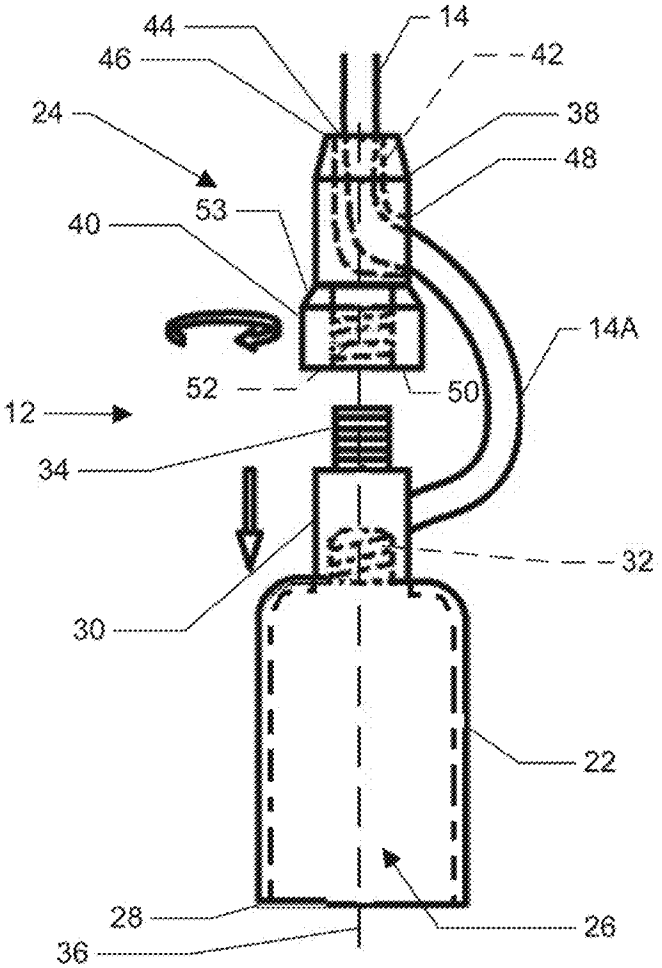
FIG. 2A is a detailed view of the pendant lamp of FIG. 1 in a disengaged arrangement.

A pendant lamp 10, according to a particular embodiment, is shown in FIGS. 1 and 2A-2B. Referring in particular to FIG. 1, the lamp 10 comprises: (1) a pendant body, generally denoted 12; (2) a cord 14 extending from the pendant body 12; (3) a canopy cover 18 that allows the cord 14 to pass therethrough; and (4) a mounting bracket 20 for attaching the lamp to a structure 16. These elements together form the lamp 10 and will be described in greater detail below.

Figure 3:
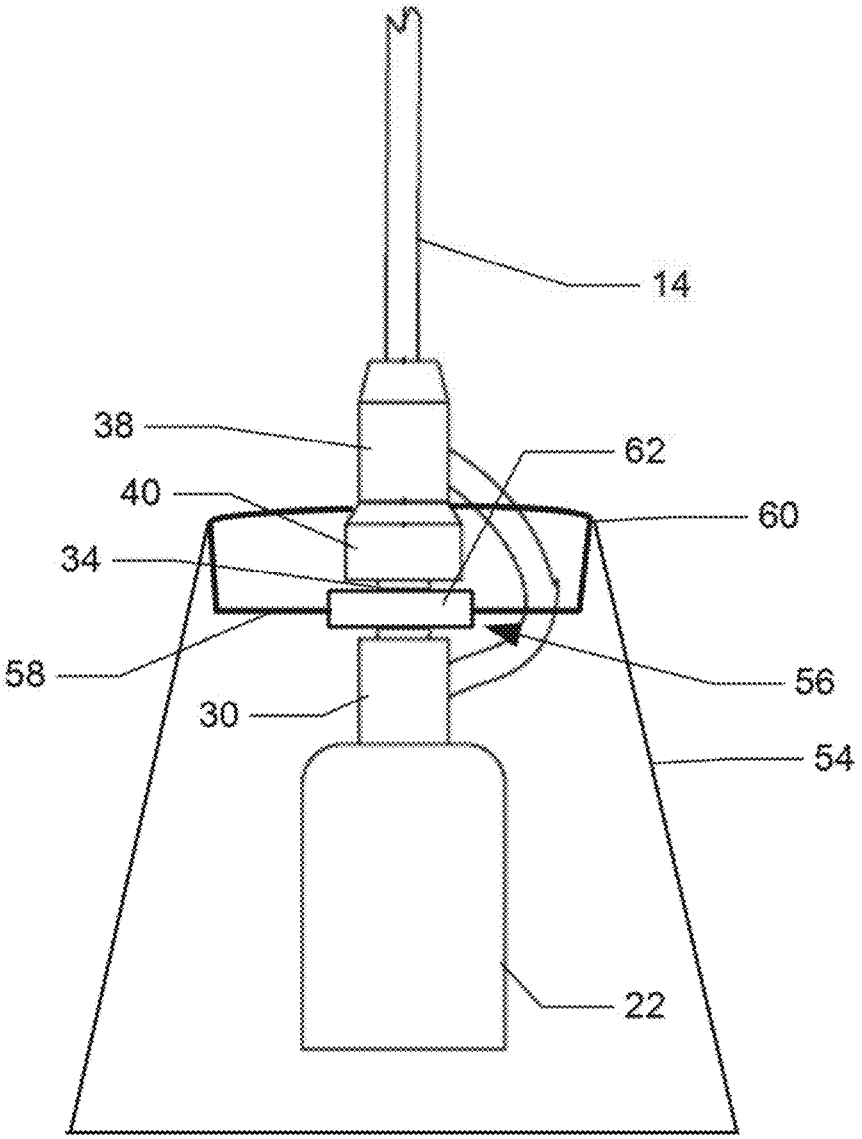
FIG. 3 is a plan view of the pendant lamp of FIG. 1 that includes a lampshade.

Referring particularly to FIG. 2A, the pendant body 12 is formed from a first body portion 22 and a second body portion 24. The first body portion 22 is generally cylindrical (e.g., cylindrical) in shape and defines a cavity 26 that extends adjacent the first body portion's first end 28, as shown in FIG. 2A. The cavity 26 is configured to receive an illumination device, such as a traditional light bulb, an LED light bulb adapter or other light filament (not shown). A back end 30 of the first body portion 22 defines a threaded socket 32 that is configured to receive a threaded end of the illumination device 11 (FIG. 3). Threaded socket 32 may be a standard bulb socket. The first body portion back end 30 contains a threaded stud 34 that is positioned so that it is substantially coaxial (e.g. coaxial) with a central axis 36 of the first body portion 22. The first body portion 22 may be formed from any of various materials such as metal, aluminum, ceramics, polymers, etc.

The second body portion 24 is generally cylindrical (e.g., cylindrical) in shape and is formed from a first half 38 and a second half 40. In various embodiments, the second body portion second half 40 rotates with respect to the second body portion first half 38. That is, the second body portion second half 40 is rotatably coupled to the second body portion first half through a screw, rivet or any other suitable connection that allows the second half 40 to rotate with respect to the first half 38. The second body portion 24 may also be formed from any of various materials such as metal, aluminum, ceramics, polymers, etc.

The second body portion first half 38 contains a bore 42 that extends therethrough. The bore 42 has a first end 44 that opens to a first end 46 of the first half 38, and a second end 48 that opens to a side surface of the first half 38. The bore 42 is configured to slidably receive a portion of the power cord 16 so that the power cord can be passed through the second body portion's first half. The cord's second end is operatively coupled to the first body portion 22 to provide power to the threaded bulb socket 32. In this way, a flexible, C-shaped power cord portion 14A is created intermediate the first body portion 22 and the second body portion 24. In various embodiments, the first half's first end 46 is frustoconical in shape. However, the first half's first end 46 may be formed having any suitable shape depending on the application of the pendant lamp 12.

The second body portion's second half 40 has a first end 50 that has a threaded bore 52 formed therein. The threaded bore 52 is formed co-linear to the first body's portion central axis 36 and is configured to receive the first body portion's threaded stud 34 therein (FIG. 2B). The second body portion's second half 40 is generally cylindrical (e.g., cylindrical) in shape with a frustoconical second end 53. It should be understood that the second body portion's second half 40 may be formed to have any shape depending on the application of the pendant lamp 12.

In alternative embodiments, the threaded stud 34 may be formed as part of the second body portion's second half 40, and the threaded bore 52 may be formed as part of the first body portion's back end 30. Thus, it should be clear from this disclosure that the bore and stud location is interchangeable between the first body portion 22 and the second body portion 24. Moreover, it should be clear from this disclosure that the threaded connection between the stud and the bore may function as a locking mechanism to removably couple the first body portion 22 to the second body portion 24.

In still other embodiments, the threads may be replaced with a spring loaded ball and corresponding detent to removably couple the first body portion to the second body portion via a snap connection. Alternatively, a spring-loaded C-clip can be used in conjunction with a circumferential detent to click-lock the stud 34 into the second body portion's bore 52. In yet another embodiment, the threads may be replaced by magnets. In all embodiments, the stud 34 is adapted to receive a portion of a lampshade that is installed on the pendent fixture intermediate the first body portion 22 and the second body portion 24. Once the lampshade is installed on the stud 34, the locking mechanism releasably couples the first body portion 22 to the second body portion 24 through stud 34 and bore 52.

Installation of the Pendant Lamp

In operation, and referring to FIG. 3, a standard lampshade 54 having a spider fitting 56 may be inserted onto threaded stud 34 so that the stud 34 extends through an opening in central portion of the spider fitting. A lampshade spider fitting may, in various embodiments, include a plurality of metal arms 58 that attach to the inside top rim 60 of the lampshade and join in the center to a hollow round metal disc 62 that resembles a washer.

After the lampshade spider fitting is positioned so that the threaded stud 34 extends through the fitting's metal disk 62, the second body portion's second half 40 is threaded onto the stud 34 and rotated until the second half's first end 50 and the first body's portion back end 30 engage the metal disc 62 on respective opposite sides of the disk 62. As noted above, the second body portion's second half 40 rotates with respect to both the first body portion 22 and the second body portion's first half 38. As a result, in various embodiments, the flexible, C-shaped power cord portion 14A remains stationary so that it does not twist as the second body portion 24 is attached to the first body portion 22. In this way, the lampshade 54 is secured to the pendant body, and all parts of the pendant body 12 and metal disc 62 remain generally collinear (e.g., collinear) along the first body portion axis 36. In this configuration, the lampshade spider fitting 56 attaches to the pendant body 12 directly centered above and close to the bulb socket in order to: (1) give the shaded fixture a substantially balanced alignment and substantially symmetrical appearance; and (2) center the socket and bulb under the spider fitting. After the first and second body portions 22, 24 are secured, the user can reduce the size of the C-shaped power cord portion 14A by pulling the power cord 14 through the second body portion's bore 42, thereby causing the C-shaped power cord portion to fit snuggly against the pendant body.

Referring again to FIG. 1, the pendant lamp 10 can be mounted to a structure 16 using the mounting bracket 20. Suitable mounting brackets, such as mounting bracket 20, are known in the art and may include screw holes (not numbered) that are used to facilitate connecting the mounting bracket to an outlet box 17 via suitable fasteners. For example, in the example shown in FIG. 1, threaded screws 21 attach mounting bracket 20 to the outlet box 17 through threaded holes 19 formed in the outlet box. The outlet box 17 defines a recessed cavity 23 in which wires 25 from power cord 14 can be spliced into wires contained in structure 16, as is well known in the art of installing fixtures.

In various embodiments, the flexible C-shaped cord portion 14A allows the user to easily attach the lampshade 54 to the rest of the pendant lamp 10 since the flexible C-shaped cord facilitates movement of the second body portion 24 relative to the first body portion 22. Moreover, since the flexible C-shaped cord portion 14A can be reduced in size by selectively sliding the cord through the bore 42, the cord 14 may be positioned to wrap snuggly around the side of the spider fitting disc to minimize its profile and any unbalanced appearance. In some embodiments, the use of a standard power cord without a rigid or thick outer protective casing around the cord further minimizes the pendant light profile. Finally, the C-shaped flexible cord portion 14A may allow the bulb inside the lampshade 54 to be positioned as close as possible to the spider fitter so as to allow a wider variety of lampshades (e.g., shorter shades) to be used with the pendant lamp 10.

First Alternate Embodiment

Figure 4:
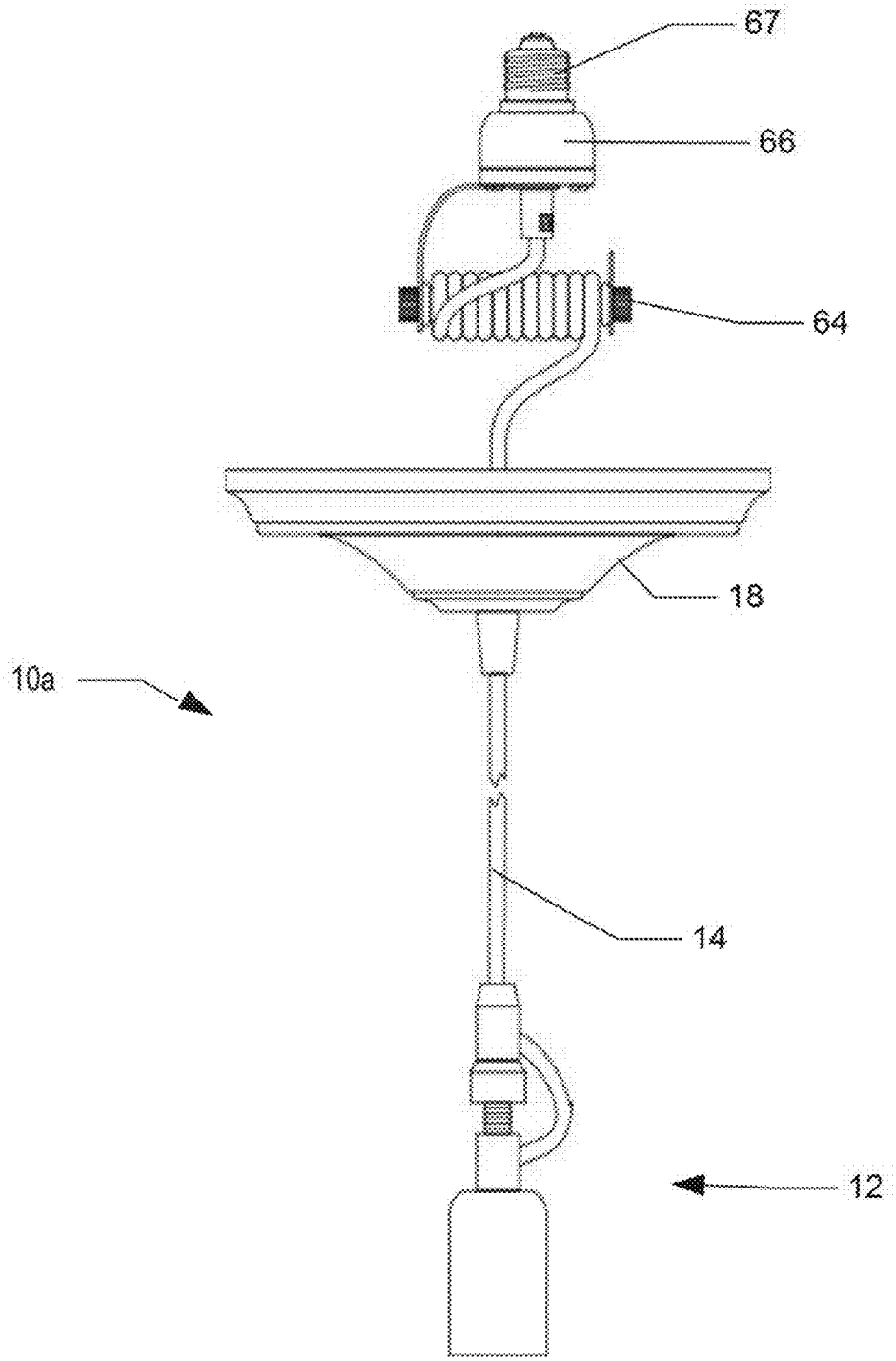
FIG. 4 is a plan view of a second embodiment of a pendant lamp.

As shown in FIG. 4, a pendant lamp 10*a* similar to that shown in FIG. 3 is illustrated having a pendant body 12, a power cord 14, a canopy cover 18, a power cord reel 64 and a light adapter 66. For ease of description, the overall pendant light illustrated in FIG. 4 is substantially the same as the light illustrated in FIG. 1, except for the power cord reel 64 and light adapter 66. Adapter 66 is configured to allow the user to convert a recessed light fixture into a hanging pendant lamp. In particular, an end 67 of light adapter 66 is sized and threaded similar to a standard light bulb so that the light adapter 66 can be inserted and screwed into an existing recessed light bulb socket. Thus, to install the pendant lamp shown in FIG. 4, the user inserts and screws the light adapter 66 into an existing light bulb socket in a recessed light fixture, and slides canopy 18 upward until it is flush against the ceiling. In this configuration, canopy 18 conceals the power cord reel and the existing recessed light fixture so that the pendant light looks like it is hardwired into the structure.

The power cord reel 64 may consist of a manual turning drum or a spring loaded, locking drum. In either case, the power cord reel 64 allows the user to adjust the height of the pendant light by adjusting the length of the power cord. That is, in some applications where the light is over a piece of furniture, the length of power cord 14 may be shortened to accommodate the height of the furniture. If the pendant light is installed over a table, the length of power cord 14 can be extended to ensure that the pendant lamp and shade is properly positioned over the table. In various embodiments using a spring-loaded power cord drum, the user can tug on the power cord to allow the drum to activate, and automatically reel in the cord to shorten the length of the power cord. In various embodiments where a manual drum is used, the user can lower the canopy 18 to expose the power cord reel 64 to provide access to the drum. The user may then manually rotate the drum to adjust the length of the cord.

Second Alternate Embodiment

Figure 5:
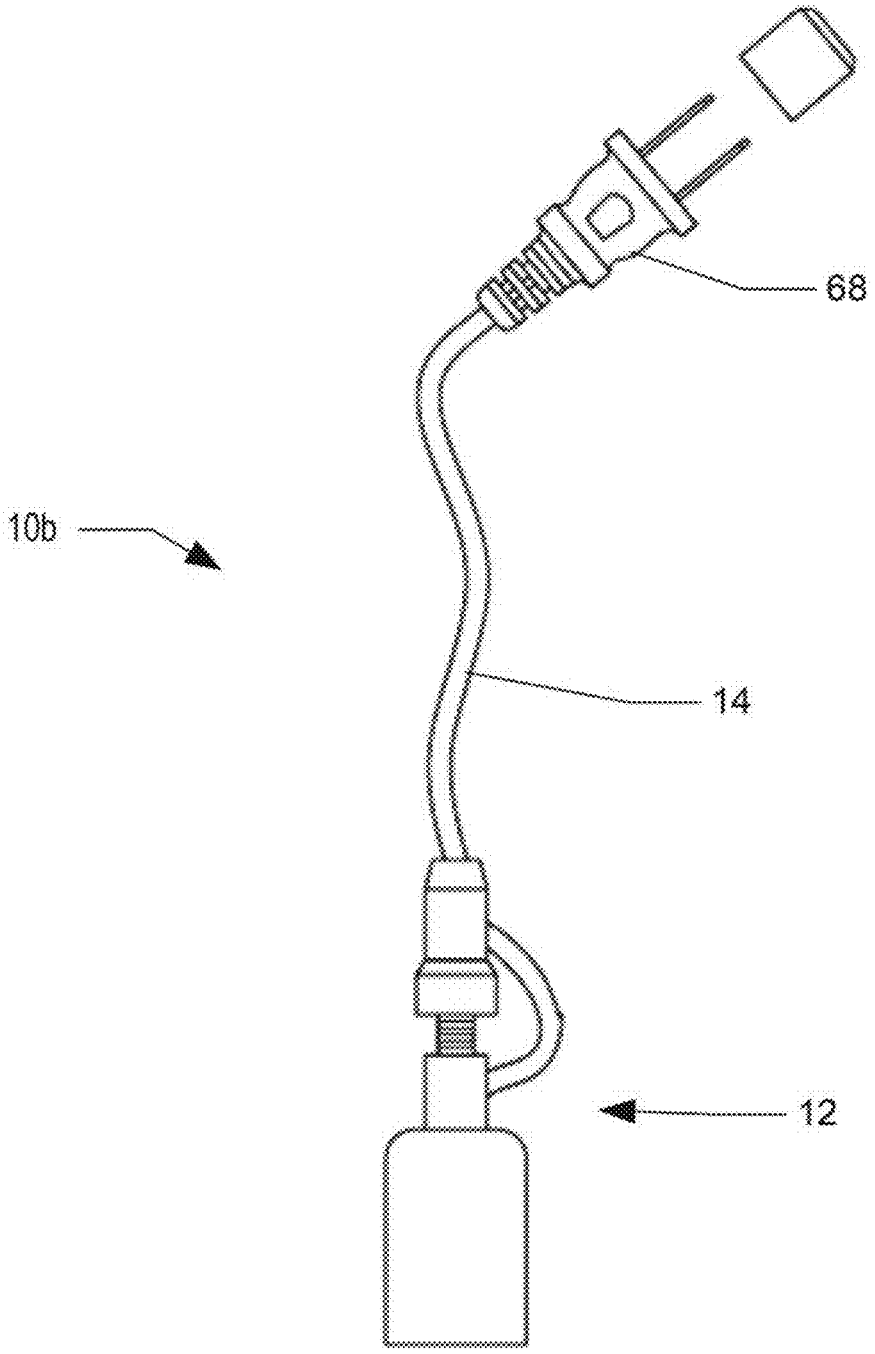
FIG. 5 is a plan view of a third embodiment of a pendant lamp.

Referring to FIG. 5, in yet another alternate embodiment, a pendant lamp 10*b*, which is substantially similar to the pendant lamps of FIGS. 1 and 4 is illustrated having a plug adapter 68. In this embodiment, the pendant lamp can be installed using hooks that hold the power cord along the ceiling so that the plug drops adjacent a power outlet on the wall and its other end with its light socket drops the power cord in the desired room location. Thus, the pendant lamp of this embodiment can be easily installed and removed by inserting or removing the plug from an outlet and not require any ceiling power receptacle. Additionally, a series of pendant lamps may be installed using a power strip that accepts a plug.

CONCLUSION

With reference to the present disclosure, various pendant lamp fixtures are disclosed that allows a user install a variety of standard lampshades on the pendent fixture. The pendant lamp is formed with a flexible C-shaped power cord portion that provides flexibility in installing the lampshade on the fixture, while maintaining the proper orientation of the shade and the fixture. Moreover, the configuration also allows a wider range of shade heights to be used without compromising the appearance of the pendant light.

Many modifications and other embodiments of the invention will come to mind to one skilled in the art to which this invention pertains having the benefit of the teachings presented in the foregoing descriptions and the associated drawings. While examples discussed above cover the use of the invention in the context a pendant lights, the invention may be used in any other suitable context. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

I claim:

1. A pendant light fixture comprising:

a. a first body portion;

b. a second body portion comprising a light bulb socket; and c. a flexible power cable that is adapted to extend through a portion of the first body portion and between the first body portion and the second body portion, and d. a stud that facilitates the attachment of the first body portion to the second body portion wherein:

(1) the power cable is adapted to power the light bulb socket, and (2) the first body portion and second body portion are configured to be selectively attached to each other and to thereby support a lamp shade, (3) the stud is adapted to facilitate attachment of the lamp shade to the pendant light fixture;

(4) the stud is adapted to extend through a substantially circular opening in the lamp shade when the lamp shade is attached to the pendant light fixture; and (5) one of the first and second body portions includes the stud and the other one of the first and second body portions includes a blind bore that is configured to receive the stud.

2. The pendant light fixture of claim 1, wherein the stud is threaded and the bore contains a corresponding threaded wall adapted to receive the threaded stud.

3. The pendant light fixture of claim 1, wherein the stud is formed from a metal and a wall of the bore is magnetized to releasably maintain the stud in the bore.

4. The pendant light fixture of claim 1, wherein the flexible power cable can be adjusted by pulling the power cable through a bore formed in the second body portion.

5. The pendant light fixture of claim 1, wherein a portion of the power cable extends adjacent corresponding lateral sides of the first and second body portions when the first and second body portions are attached to each other.

6. The pendent light fixture of claim 5, wherein a length of the portion of the power cable is adjustable.

7. The pendant light fixture of claim 1, further comprising a canopy that is slidably received on the power cable.

8. The pendant light fixture of claim 7, further comprising a power cable first end further comprising an adapter that is configured to releasably couple to a light bulb socket of a recessed light fixture and wherein the slidable canopy is configured to cover the recessed light fixture.

9. The pendant light fixture of claim 8, further comprising an adjustable power cable reel that is coupled to the adapter and configured to allow adjustment of a length of the power cable.

10. A pendant light fixture comprising:

a. a first body portion having one of a stud and a first bore;

b. a second body portion having the other of the stud and the first bore and having a second bore therethrough;

c. a power cord having:

i. a first end for mounting to a structure, and ii. a second end that is received through the second bore, wherein the power cord second end is coupled to the first body portion and configured to provide power thereto, and a length of power cord adjacent to the power cord second end defines a flexible and adjustable C-shaped power cord portion that extends between the first body portion and the second body portion, one of the stud and a wall of the bore magnetized and the other one of the stud and the wall of the bore is formed from metal, wherein the stud is:

configured to receive a spider fitting of a lampshade when the lampshade is installed on the pendant fixture, and removably received in the first bore.

11. The pendant light fixture of claim 10, the second body portion further comprising a first half having the second bore therethrough and a second half having the other of the stud and the bore, wherein the second half is rotatably coupled to the first half.

12. The pendant light fixture of claim 10, wherein when a lampshade is installed on the stud, a portion of the lampshade is received intermediate the first body portion and the second body portion when the stud is removably received by the first bore.

13. A pendant light fixture comprising:

a. a first body portion having one of a stud and a bore;

b. a second body portion having the other of the stud and the bore and having a second bore therethrough;

c. a power cord having:

i. a first end for mounting to a structure, and ii. a second end that is received through the second bore, wherein the power cord second end is coupled to the first body portion and configured to provide power thereto, and a length of power cord adjacent to the power cord second end defines a flexible and adjustable C-shaped power cord portion that extends between the first body portion and the second body portion, one of the stud and the bore includes a detent and the other of the stud and the bore includes a catch that is configured to receive the detent, wherein the stud is:

configured to receive a spider fitting of a lampshade when the lampshade is installed on the pendant fixture, and removably received in the bore by a locking mechanism.

14. A method for installing a lampshade to a pendant light fixture comprising:

a. providing a pendant light fixture having i. a first body portion having one of a stud and a bore;

ii. a second body portion having the other of the stud and the bore and a second bore formed therethrough, and iii. a power cord having a first end and a second end, wherein a) the power cord second end is received through the second body portion second bore, b) the power cord second end is operatively coupled to the first body portion so that an adjustable, C-shaped portion of the power cord is disposed between the first body portion and the second body portion, and the stud is removably received in the second body portion bore and retained therein by a locking mechanism;

b. inserting a portion of a lampshade on the stud;

c. inserting the stud into the bore so that the locking mechanism secures the lampshade intermediate the first body portion and the second body portion; and d. adjusting a length of the C-shaped portion of the power cord once the stud is inserted into the bore.

15. The method of claim 14, wherein the locking mechanism is chosen from a group consisting of:

a. threads;

b. a spring loaded ball and a corresponding detent; and c. a spring loaded C-clip and a corresponding detent.

* * * * *